US010088198B2

(12) United States Patent
Kawagoe et al.

(10) Patent No.: US 10,088,198 B2
(45) Date of Patent: Oct. 2, 2018

(54) AIR-CONDITIONING AND HOT WATER SUPPLYING COMPOSITE SYSTEM

(71) Applicant: Mitsubishi Electric Corporation, Tokyo (JP)

(72) Inventors: Tomokazu Kawagoe, Tokyo (JP); Hirofumi Koge, Tokyo (JP); Osamu Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 15 days.

(21) Appl. No.: 15/518,629

(22) PCT Filed: Nov. 27, 2014

(86) PCT No.: PCT/JP2014/081348

§ 371 (c)(1),
(2) Date: Apr. 12, 2017

(87) PCT Pub. No.: WO2016/084186

PCT Pub. Date: Jun. 2, 2016

(65) Prior Publication Data

US 2017/0234576 A1 Aug. 17, 2017

(51) Int. Cl.

| | |
|---|---|
| ***F24H 4/04*** | (2006.01) |
| ***F25B 49/02*** | (2006.01) |
| ***F24H 9/20*** | (2006.01) |

(52) U.S. Cl.

CPC ..... *F24H 9/2007* (2013.01); *F24H 4/04* (2013.01); *F25B 49/022* (2013.01)

(58) Field of Classification Search

CPC ..... F24H 4/04; F24H 9/2007; F25B 49/022; F25B 2313/02334; F25B 2700/2116; F25B 2700/21161

See application file for complete search history.

(56) References Cited

U.S. PATENT DOCUMENTS

2011/0314848 A1* 12/2011 Tanaka ..... F25B 13/00 62/126
2013/0213072 A1* 8/2013 Kawagoe ..... F25B 13/00 62/238.6

(Continued)

FOREIGN PATENT DOCUMENTS

| | | |
|---|---|---|
| EP | 2 781 848 A1 | 9/2014 |
| WO | 2013/046269 A1 | 4/2013 |
| WO | 2014/106895 A1 | 7/2014 |

OTHER PUBLICATIONS

International Search Report of the International Searching Authority dated Mar. 3, 2015 for the corresponding international application No. PCT/JP2014/081348 (and English translation).

(Continued)

*Primary Examiner* — Marc Norman
(74) *Attorney, Agent, or Firm* — Posz Law Group, PLC

(57) ABSTRACT

An air-conditioning and hot water supplying composite system includes a heat source unit and a heat source-side heat exchanger, an indoor heat source unit, a hot water supply unit connected to the heat source unit and including a hot water supply-side heat exchanger and a hot water supply-side expansion device, and a controller that controls the heat source unit. The controller includes a mode switching unit that switches a control mode of the air-conditioning and hot water supplying composite system between a hot water supply control mode, a hot water supply preheating mode, and a condensing temperature control unit. The condensing temperature control unit determines the target condensing temperature according to a temperature of a heat medium subjected to heat exchange by the hot water supply unit, in the hot water supply control mode.

9 Claims, 8 Drawing Sheets

(56) References Cited

U.S. PATENT DOCUMENTS

| | | | | |
|---|---|---|---|---|
| 2013/0219945 | A1* | 8/2013 | Koge | F25B 13/00 62/324.6 |
| 2015/0040595 | A1* | 2/2015 | Tamaki | F25B 13/00 62/159 |
| 2015/0330675 | A1 | 11/2015 | Tamaki et al. | |

OTHER PUBLICATIONS

Office Action dated Oct. 3, 2017 issued in corresponding JP patent application No. 2016-561158 (and English translation).

* cited by examiner (a)

(b)

AIR-CONDITIONING AND HOT WATER SUPPLYING COMPOSITE SYSTEM

CROSS REFERENCE TO RELATED APPLICATION

This application is a U.S. national stage application of PCT/JP2014/081348 filed on Nov. 27, 2014, the contents of which are incorporated herein by reference.

TECHNICAL FIELD

The present invention relates to an air-conditioning and hot water supplying composite system including a heat pump cycle and configured to perform a heating operation and a hot water supplying operation.

BACKGROUND ART

Air-conditioning and hot water supplying composite systems have thus far been proposed that include a heat pump cycle and is configured to exchange heating energy with a heat source (air or water) and supply the heating energy to one or a plurality of indoor units and hot water supply units. For example, Patent Literature 1 proposes an air-conditioning and hot water supplying composite system including a heat source unit having a compressor and a heat source-side heat exchanger, an indoor unit having an indoor heat exchanger and an indoor expansion device, and a hot water supply unit having a hot water supply-side heat exchanger and a hot water supply-side expansion device.

The air-conditioning and hot water supplying composite system disclosed in Patent Literature 1 is configured to perform, with a single refrigerant system, a heating operation in which the indoor heat exchanger serves as condenser (radiator) and a hot water supplying operation in which the hot water supply-side heat exchanger exchanges heat with water so as to heat the water, at the same time.

Thus, a low-cost and space-saving air-conditioning and hot water supplying composite system, to which there is no need to connect a plurality of refrigerant systems, can be attained.

CITATION LIST

Patent Literature

Patent Literature 1: International Publication No. 2013/046269

SUMMARY OF INVENTION

Technical Problem

In the air-conditioning and hot water supplying composite system based on a single refrigerant system, such as the one disclosed in Patent Literature 1, the hot water supply unit serves as hot water preheater that heats water in a tank in advance with surplus heating energy from the heating operation, to reduce the fuel cost of a gas boiler. Accordingly, although the heating operation and the hot water supplying operation can be performed at the same time, the refrigerant control of the heat source unit is specialized for the air-conditioning use. Therefore, when the hot water supply unit is utilized as water heater in the conventional air-conditioning and hot water supplying composite system, water delivery temperature control for the hot water is unable to be stably performed in a low-temperature range, and the coefficient of performance (COP) is degraded in a high-temperature range.

The present invention has been accomplished in view of the foregoing problem, and provides an air-conditioning and hot water supplying composite system that allows a hot water supply unit to stably perform water delivery temperature control and improve a COP.

Solution to Problem

In one embodiment, the present invention provides an air-conditioning and hot water supplying composite system including a heat source unit including a compressor and a heat source-side heat exchanger, an indoor unit connected to the heat source unit and including an indoor heat exchanger and an indoor expansion device, the indoor unit being configured to perform a heating operation, a hot water supply unit connected to the heat source unit and including a hot water supply-side heat exchanger and a hot water supply-side expansion device, the hot water supply unit being configured to perform a hot water supplying operation, and a controller that controls the heat source unit. The controller includes a mode switching unit that switches a control mode between a hot water supply control mode in which the hot water supplying operation is primarily performed and a hot water supply preheating mode in which the heating operation is primarily performed, and a condensing temperature control unit that determines a target condensing temperature depending on the control mode. The condensing temperature control unit determines the target condensing temperature according to a temperature of a heat medium subjected to heat exchange by the hot water supply unit, in the hot water supply control mode.

Advantageous Effects of Invention

In the air-conditioning and hot water supplying composite system according to the present invention, the target condensing temperature is determined according to the temperature of the heat medium subjected to heat exchange by the hot water supply unit, in the hot water supply control mode. Therefore, the hot water supply unit can stably perform the water delivery temperature control and improve the COP.

DESCRIPTION OF EMBODIMENTS

Hereafter, Embodiments of the air-conditioning and hot water supplying composite system according to the present invention will be described in detail with reference to the drawings.

Embodiment 1

Figure 1:
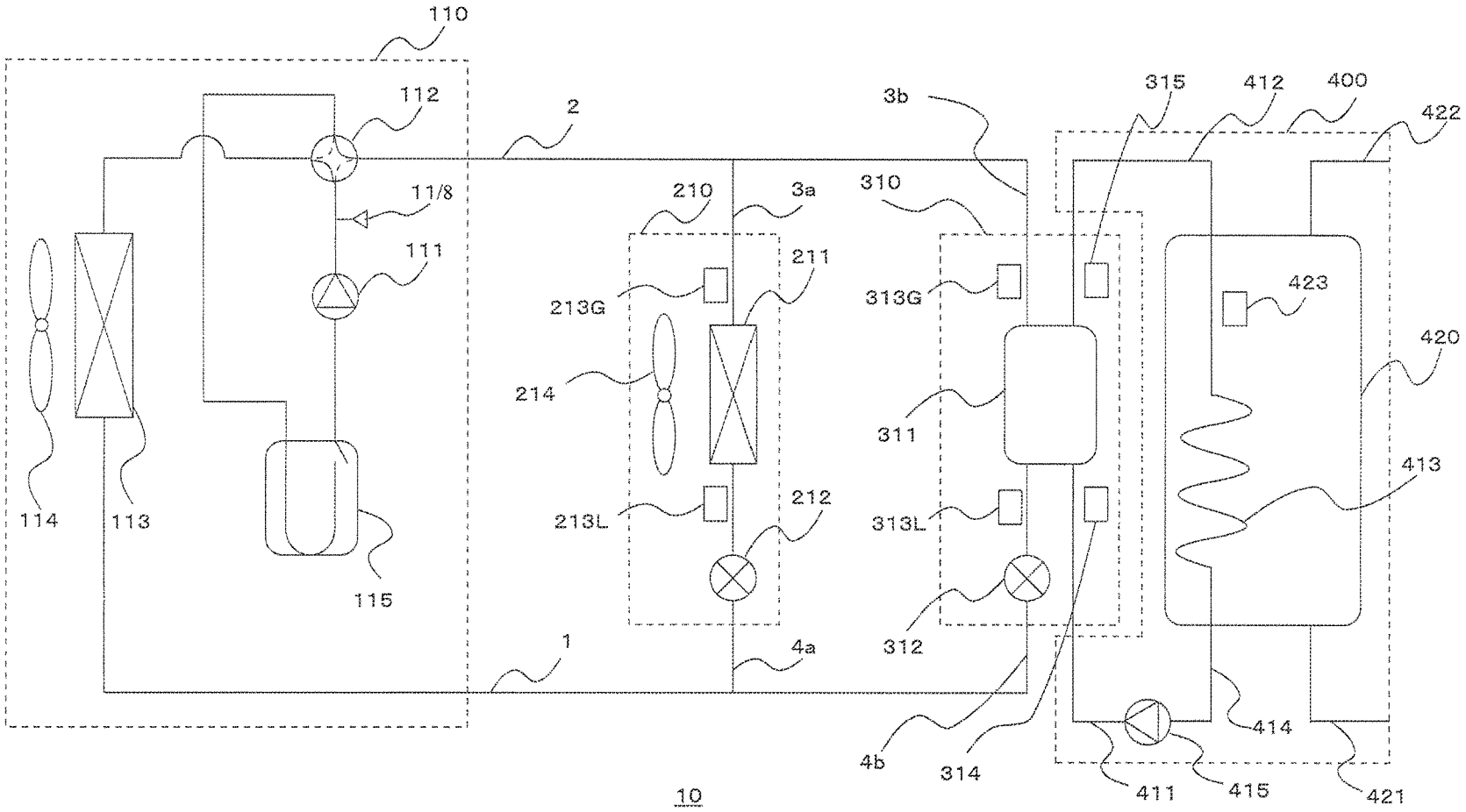
FIG. 1 is a circuit diagram showing a refrigerant circuit configuration of an air-conditioning and hot water supplying composite system according to Embodiment 1 of the present invention.

FIG. 1 is a circuit diagram showing a refrigerant circuit configuration of an air-conditioning and hot water supplying composite system 10 according to Embodiment 1 of the present invention. The air-conditioning and hot water supplying composite system 10 according to Embodiment 1 is intended for use in a building, a condominium, a hotel, or the like, and configured to supply an air-conditioning load (heating load and cooling load) and a hot water supplying load (heating load and cooling load) at the same time, by utilizing a heat pump cycle (refrigeration cycle) in which refrigerant circulates.

As shown in FIG. 1, the air-conditioning and hot water supplying composite system 10 includes a heat source unit 110, an indoor unit 210, and a hot water supply unit 310. The indoor unit 210 and the hot water supply unit 310 are connected in parallel with respect to the heat source unit 110.

The heat source unit 110 and the indoor unit 210 are connected to each other via a liquid main pipe 1, a liquid branch pipe 4*a*, a gas branch pipe 3*a*, and a gas main pipe 2, each constituting a part of a refrigerant pipe. The heat source unit 110 and the hot water supply unit 310 are connected to each other via the liquid main pipe 1, a liquid branch pipe 4*b*, a gas branch pipe 3*b*, and the gas main pipe 2, each constituting a part of the refrigerant pipe. In addition, a heat medium circuit 400 is connected to the hot water supply unit 310 via a heat medium pipe 411 and a heat medium pipe 412.

Here, in Embodiment 1 a single indoor unit 210 and a single hot water supply unit 310 are connected to a single heat source unit 110 as shown in FIG. 1, however the number of these units is not specifically limited. For example, two or more heat source units 110, two or more indoor units 210, or two or more hot water supply units 310 may be connected to constitute the air-conditioning and hot water supplying composite system 10.

(Heat Source Unit 110)

The heat source unit 110 serves to supply heating energy or cooling energy to the indoor unit 210 and the hot water supply unit 310. The heat source unit 110 includes a compressor 111, a flow switching device 112, a heat source-side heat exchanger 113, and an accumulator 115, which are connected in series. In addition, the heat source unit 110 includes a fan 114 located close to the heat source-side heat exchanger 113 so as to supply air to the heat source-side heat exchanger 113. Further, a pressure sensor 116 that detects refrigerant discharge pressure is provided on the discharge side of the compressor 111.

The compressor 111 sucks and compresses the refrigerant to turn it into a high-temperature and high-pressure state. The type of the compressor 111 is not specifically limited provided that the sucked refrigerant can be compressed into the high-pressure state. The compressor 111 may be, for example, of a reciprocating type, a rotary type, a scroll type, or a screw type. The revolution speed of the compressor 111 is variably controlled by a controller 120 (FIG. 2) to be subsequently described.

The flow switching device 112 switches the flow of the refrigerant according to a required operation mode (cooling or heating), and is constituted of a four-way valve, for example. The heat source-side heat exchanger 113 serves as radiator (condenser) in a cooling cycle and as evaporator in a heating cycle, to exchange heat between the air supplied by the fan 114 and the refrigerant thereby condensing and liquefying or evaporating and gasifying the refrigerant. The fan 114 may be, for example, a centrifugal fan or a multi-blade fan driven by a non-illustrated motor. The air volume of the fan 114 is regulated by the controller 120. The accumulator 115 is located on the suction side of the compressor 111. In a system designed to perform both of the heating (water-heating) operation and the cooling (water-cooling) operation, like the air-conditioning and hot water supplying composite system 10 according to Embodiment 1, some amount of refrigerant is left over in the heating operation. Therefore, the surplus refrigerant is stored in the accumulator 115. Here, it suffices that the accumulator 115 is constituted of a container for storing the surplus refrigerant therein.

(Indoor Unit 210)

The indoor unit 210 serves to bear heating load or cooling load by receiving the heating energy or the cooling energy from the heat source unit 110. The indoor unit 210 includes an indoor expansion device 212 and an indoor heat exchanger 211 connected in series to each other. In addition, a gas pipe temperature sensor 213G is provided on the gas branch pipe 3*a* of the indoor unit 210. Further, a liquid pipe temperature sensor 213L is provided between the indoor expansion device 212 on the liquid branch pipe 4*a* and the indoor heat exchanger 211. Still further, a fan 214 that supplies air to the indoor heat exchanger 211 is located close thereto.

The indoor heat exchanger 211 serves as radiator (condenser) in the heating cycle and as evaporator in the cooling cycle, to exchange heat between the air supplied by the fan 214 and the refrigerant thereby condensing and liquefying or evaporating and gasifying the refrigerant. The indoor expansion device 212 is configured to serve as pressure reducing valve or expansion valve, so as to depressurize and expand the refrigerant. The indoor expansion device 212 may be, for example, an electronic expansion valve capable of precisely controlling the flow rate, or an inexpensive capillary tube, the opening degree (aperture) of which is variably controlled by a controller 220 (FIG. 2) to be subsequently described. The gas pipe temperature sensor 213G detects the temperature of the refrigerant flowing in the gas branch pipe 3*a*, and the liquid pipe temperature sensor 213L detects the temperature of the refrigerant flowing in the liquid branch pipe 4*a*. The information of the temperature detected by the gas pipe temperature sensor 213G and the liquid pipe temperature sensor 213L is output to the controller 220.

(Hot Water Supply Unit 310)

The hot water supply unit 310 is configured to supply the heating energy or the cooling energy from heat source unit 110 to the heat medium circuit 400 through the hot water supply-side heat exchanger 311. The hot water supply unit 310 includes a hot water supply-side expansion device 312 and a hot water supply-side heat exchanger (refrigerant-heat medium heat exchanger) 311, connected in series to each other. A gas pipe temperature sensor 313G is provided on the gas branch pipe 3*b* of the hot water supply unit 310. In addition, a liquid pipe temperature sensor 313L is provided between the hot water supply-side expansion device 312 on the liquid branch pipe 4*b* and the hot water supply-side heat exchanger 311. Further, an inlet temperature sensor 314 is provided on the heat medium pipe 412, and an outlet temperature sensor 315 is provided on the heat medium pipe 412.

The hot water supply-side heat exchanger 311 serves as radiator (condenser) in the water-heating (heating) cycle and as evaporator in the water-cooling (cooling) cycle, to exchange heat between the heat medium flowing in the heat medium circuit 400 and the refrigerant. The hot water supply-side expansion device 312 is configured to serve as pressure reducing valve or expansion valve, so as to depressurize and expand the refrigerant. The hot water supply-side expansion device 312 may be, for example, an electronic expansion valve configured to precisely control the flow rate, or an inexpensive capillary tube, the opening degree (aperture) of which is variably controlled by a controller 320 (FIG. 2) to be subsequently described. The gas pipe temperature sensor 313G detects the temperature of the refrigerant flowing in the gas branch pipe 3*b*, and the liquid pipe temperature sensor 313L detects the temperature of the refrigerant flowing in the liquid branch pipe 4*b*. The information of the temperature detected by the gas pipe temperature sensor 313G and the liquid pipe temperature sensor 313L is output to the controller 320. The inlet temperature sensor 314 detects the temperature of the heat medium at the inlet of the hot water supply unit 310, and the outlet temperature sensor 315 detects the temperature of the heat medium at the outlet. The information of the temperature detected by the inlet temperature sensor 314 and the outlet temperature sensor 315 is output to the controller 320.

(Heat Medium Circuit 400)

The heat medium circuit 400 includes a pump 415 and a hot water storage tank 420. The heat medium circuit 400 is composed of the heat medium pipe 411, the hot water supply-side heat exchanger 311, the heat medium pipe 412, a heat medium-water heat exchanger 413 in the hot water storage tank 420, a heat medium pipe 414, and the pump 415, which are connected in series. In the heat medium circuit 400, the heat medium heated or cooled in the hot water supply-side heat exchanger 311 is allowed to circulate by the pump 415, to thereby enable hot water or cold water to be utilized. In addition, a water pipe 421 serving as water supply pipe (or return pipe), and a water pipe 422 through which the heated water is supplied, are connected to the hot water storage tank 420, so that the water is supplied to the load side by a non-illustrated pump. In addition, a water temperature sensor 423 that detects the temperature of the water in the tank is provided in the hot water storage tank 420. The water temperature sensor 423 may be located at a desired position, according to the usage.

The heat medium pipe constituting the heat medium circuit 400 may be formed of copper, stainless steel, PVC, or the like. Although water is normally employed as the heat medium circulating in the heat medium circuit 400, antifreeze fluid or the like may be employed. In a circumstance where the water temperature is low and the heat medium pipe 411 and the heat medium pipe 412 are likely to be frozen, an antifreeze agent (brine) may be mixed in the water. The type and the concentration of the antifreeze agent is not specifically limited and, for example, ethylene glycol or propylene glycol may be adopted according to the availability and the usage.

Examples of the refrigerant applicable to the refrigeration cycle of the air-conditioning and hot water supplying composite system 10 include a non-azeotropic refrigerant mixture, a near-azeotropic refrigerant mixture, and a single refrigerant. The non-azeotropic refrigerant mixture is exemplified by R4070 (R32/R125/R134a) which is a hydrofluorocarbon (HFC) refrigerant. The non-azeotropic refrigerant mixture is a mixture of refrigerants different in boiling point, and hence has a characteristic that the composition ratio of liquid-phase refrigerant and gas-phase refrigerant is different. The near-azeotropic refrigerant mixture can be exemplified by R410A (R32/R125) and R404A (R125/R143a/R134a), which are HFC refrigerants. The near-azeotropic refrigerant mixture accepts a working pressure 1.6 times that of R22, in addition to the same characteristics as those of the non-azeotropic refrigerant mixture.

The single refrigerant can be exemplified by R22 which is a hydrochlorofluorocarbon (HCFC) refrigerant, and R134a which is a HFC refrigerant. The single refrigerant has an advantage in that the handling is easy, because of not being a mixture. In addition, carbon dioxide which is a natural refrigerant, or propane, isobutane, or ammonium may be employed. Here, R22 represents chlorodifluoromethane, R32 represents difluoromethane, R125 represents pentafluoromethane, R134a represents 1, 1, 1, 2-tetrafluoromethane, and R143a represents 1, 1, 1-trifluoromethane. Therefore, it is desirable to select a suitable refrigerant according to the usage and application of the air-conditioning and hot water supplying composite system 10.

Figure 2:
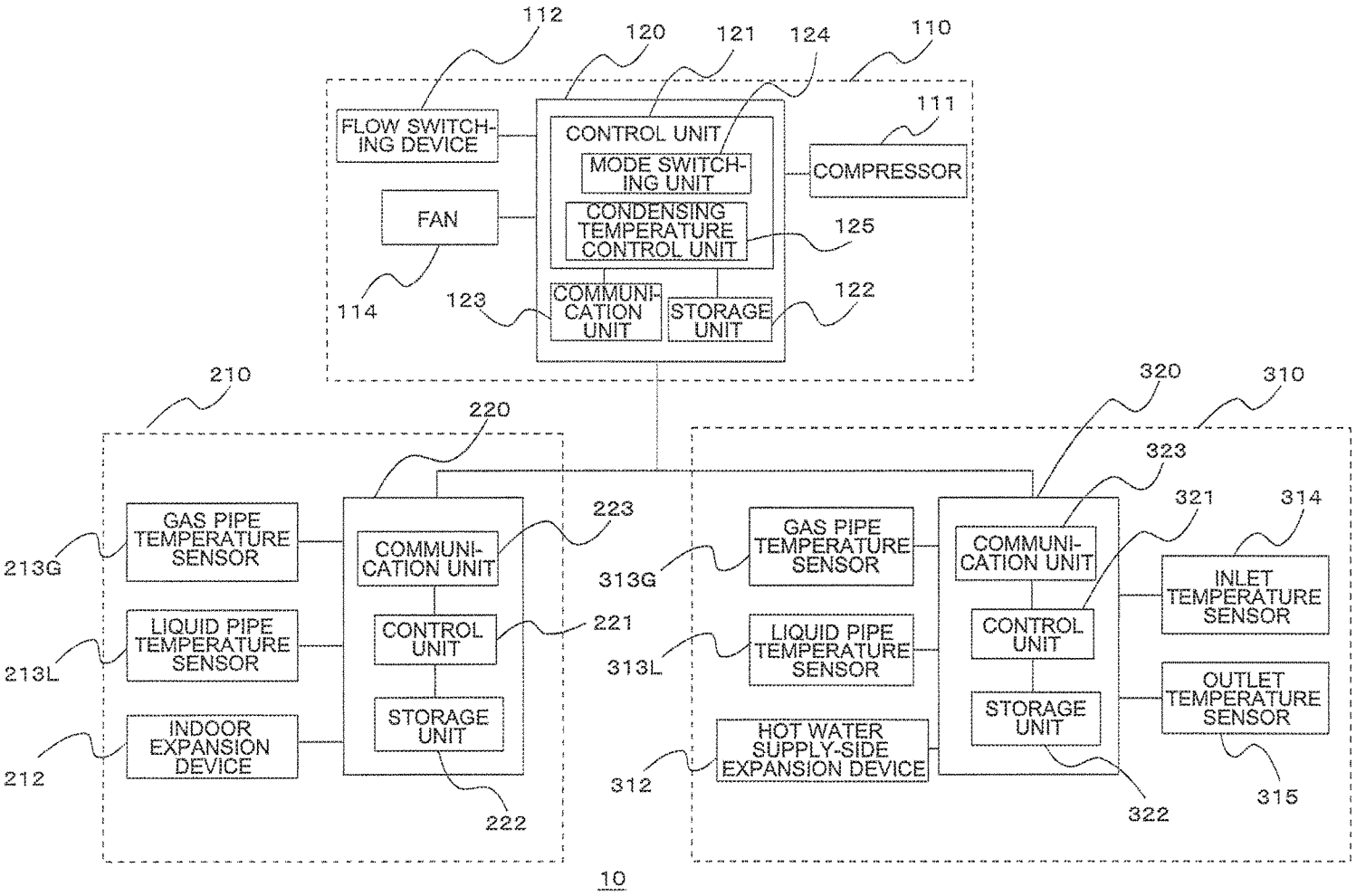
FIG. 2 is a functional block diagram of the air-conditioning and hot water supplying composite system according to Embodiment 1 of the present invention.

FIG. 2 is a functional block diagram of the air-conditioning and hot water supplying composite system 10 according to Embodiment 1. The heat source unit 110, the indoor unit 210, and the hot water supply unit 310 according to Embodiment 1 respectively include the controller 120, the controller 220, and the controller 320. The controller 120, the controller 220, and the controller 320 are each constituted of a microcomputer, a digital signal processor (DSP), or the like.

The controller 120 of the heat source unit 110 includes a control unit 121, a communication unit 122, and a storage unit 123. The control unit 121 is configured to control the pressure and the temperature of the refrigerant in the air-conditioning and hot water supplying composite system 10. More specifically, the control unit 121 controls the circulation amount of the refrigerant from the compressor 111 through a non-illustrated inverter so as to match the temperature to a target condensing temperature CTm, and also controls the heat exchange capacity by regulating the revolution speed of the fan 114 through a non-illustrated inverter, so as to match the temperature to a target evaporating temperature ETm, in the heating and water-heating operation. In the cooling and water-cooling operation, the control unit 121 controls the circulation amount of the refrigerant from the compressor 111 so as to match the temperature to the target evaporating temperature ETm, and also controls the heat exchange capacity by regulating the revolution speed of the fan 114 through the inverter, so as to match the temperature to the target condensing temperature CTm. The control unit 121 also controls the switching of the flow switching device 112 so as to switch between the heating (water-heating) operation and the cooling (water-cooling) operation. Further, in the case where the heat source-side heat exchanger 113 is divided into a plurality of heat exchangers and a non-illustrated on/off valve is provided for each of the heat exchangers on the primary side of the heat source-side heat exchanger 113, the control unit 121 controls the on/off valve so as to regulate the area through which the heat source-side heat exchanger 113 performs the heat exchange.

The control unit 121 according to Embodiment 1 also includes a mode switching unit 124 and a condensing temperature control unit 125. The mode switching unit 124 switches the control mode of the heat source unit 110 according to the operation status of the air-conditioning and hot water supplying composite system 10 and the temperature of the heat medium subjected to the heat exchange in the hot water supply unit 310. In Embodiment 1, the control modes in the heating (water-heating) operation include a "hot water supply preheating mode" in which the indoor unit 210 primarily performs the heating operation, and a "hot water supply control mode" in which the hot water supply unit 310 primarily performs the hot water supplying operation. The condensing temperature control unit 125 determines the target condensing temperature CTm in the refrigeration cycle according to the control mode of the heat source unit 110, and controls the compressor 111. The mode switching unit 124 and the condensing temperature control unit 125 may be realized by functional blocks realized by execution of a program, or by an electronic circuit such as an application specific IC (ASIC).

The communication unit 122 allows wireless or wired communication between the components of the heat source unit 110 connected to the controller 120, as well as the controller 220 of the indoor unit 210 and the controller 320 of the hot water supply unit 310, for transmission and reception of information. The storage unit 123 stores therein various types of information to be used by the control unit 121 to perform the control. The storage unit 123 stores, for example, the target condensing temperature CTm and the target evaporating temperature ETm, as well as a first threshold A, a second threshold B, and a constant $\alpha$ to be subsequently described.

The controller 220 of the indoor unit 210 includes a control unit 221, a communication unit 222, and a storage unit 223. The control unit 221 controls a degree of superheating when the indoor unit 210 is performing the cooling operation, and a degree of subcooling when the indoor unit 210 is performing the heating operation, according to the information output from the gas pipe temperature sensor 213G and the liquid pipe temperature sensor 213L. More specifically, the controller 220 determines the control amount of the indoor expansion device 212 thereby controlling the flow rate of the refrigerant in the indoor expansion device 212. Further, in the case where the indoor heat exchanger 211 is divided into a plurality of heat exchangers and a non-illustrated on/off valve is provided for each of the heat exchangers on the primary side of the indoor heat exchanger 211, the control unit 221 controls the on/off valve so as to regulate the area through which the indoor heat exchanger 211 performs the heat exchange.

The communication unit 222 allows wireless or wired communication between the components of the indoor unit 210 connected to the controller 220, as well as the controller 120 of the heat source unit 110 and the controller 320 of the hot water supply unit 310, for transmission and reception of information. The storage unit 223 stores therein various types of information to be used by the control unit 221 to perform the control.

The controller 320 of the hot water supply unit 310 includes a control unit 321, a communication unit 322, and a storage unit 323. The control unit 321 controls a degree of superheating when the hot water supply unit 310 is performing the water-cooling operation, a degree of subcooling when the hot water supply unit 310 is performing the water-heating operation, and a water delivery temperature, according to the information output from the gas pipe temperature sensor 313G, the liquid pipe temperature sensor 313L, the inlet temperature sensor 314, and the outlet temperature sensor 315. More specifically, the controller 320 determines the extent of controlling the hot water supply-side expansion device 312 thereby controlling the flow rate of the refrigerant in the hot water supply-side expansion device 312. Further, in the case where the hot water supply-side heat exchanger 311 is divided into a plurality of heat exchangers and a non-illustrated on/off valve is provided for each of the heat exchangers on the primary side of the hot water supply-side heat exchanger 311, the control unit 321 controls the on/off valve so as to regulate the area through which the hot water supply-side heat exchanger 311 performs the heat exchange.

The communication unit 322 allows wireless or wired communication between the components of the hot water supply unit 310 connected to the controller 320, as well as the controller 120 of the heat source unit 110 and the controller 220 of the indoor unit 210, for transmission and reception of information. The storage unit 323 stores therein various types of information to be used by the control unit 321 to perform the control.

Although the heat source unit 110, the indoor unit 210, and the hot water supply unit 310 each include the controller so as to execute processing in linkage with each other through communication of the information in FIG. 2, a single controller that controls the entirety of the air-conditioning and hot water supplying composite system 10 may be provided instead.

Further, though not illustrated in FIG. 1 and FIG. 2, the air-conditioning and hot water supplying composite system 10 may also include a sensor for detecting suction pressure of the refrigerant, a sensor for detecting discharge temperature of the refrigerant, a sensor for detecting suction temperature of the refrigerant, a sensor for detecting temperature of the refrigerant flowing into and out of the heat source-side heat exchanger 113, a sensor for detecting temperature of atmospheric air sucked into the heat source unit 110, or a sensor for detecting temperature of air sucked into or blown out of the indoor heat exchanger 211. The information detected by those sensors (measurement information such as temperature information and pressure information) is transmitted to the respective controllers of the heat source unit 110, the indoor unit 210, and the hot water supply unit 310, to be utilized to control the actuators, namely the compressor 111, the flow switching device 112, the fan 114, the indoor expansion device 212, or the hot water supply-side expansion device 312.

Hereunder, the operation of the air-conditioning and hot water supplying composite system 10 will be described. The air-conditioning and hot water supplying composite system 10 performs the heating operation, the cooling operation, the water-heating operation, and the water-cooling operation. In addition, the air-conditioning and hot water supplying composite system 10 performs a mixed operation of the heating operation and the water-heating operation, as well as a mixed operation of the cooling operation and the water-cooling operation. In the heating operation and the water-heating operation, the flow switching device 112 is switched as indicated by broken lines in FIG. 1, while in the cooling operation and the water-cooling operation the flow switching device 112 is switched as indicated by solid lines in FIG. 1. The switching between the air-conditioning operation (heating or cooling) and the hot water supplying operation (water-heating or water-cooling) is performed by fully closing one of the indoor expansion device 212 and the hot water supply-side expansion device 312.

In the air-conditioning and hot water supplying composite system 10 according to Embodiment 1, the hot water supply unit 310 and the indoor unit 210 are connected to a single refrigerant system (heat source unit 110). Such a system is normally utilized to perform one of the water-heating operation (hot water supplying operation) in which the high-temperature and high-pressure refrigerant from the compressor 111 is supplied to the hot water supply unit 310 so as to heat the water in the hot water storage tank 420, and the heating operation (air-conditioning operation) in which the high-temperature and high-pressure refrigerant from the compressor 111 is supplied to the indoor unit 210 so as to supply hot air into the room. For example, the water-heating operation is performed for 1 to 2 hours at midnight or in a period designated as midnight, and the air-conditioning operation is performed from morning until midnight. The water thus thoroughly heated is stored in the tank, to be consumed through the day.

Referring to FIG. 1, the flow of the refrigerant in the heating operation, the water-heating operation, the cooling operation, the water-cooling operation, and the mixed operation will be sequentially described hereunder. The description of the mixed operation will be given on the assumption that the heating operation and the water-heating operation are performed at the same time.

(Heating Operation)

In the heating operation, the high-pressure gas refrigerant, heated and compressed by the compressor 111, is transported to the indoor unit 210 through the flow switching device 112, the gas main pipe 2, and the gas branch pipe 3*a*. The refrigerant transported to the indoor unit 210 radiates heat to the room air in the indoor heat exchanger 211, thereby turning into high-pressure liquid refrigerant through condensation. The high-pressure liquid refrigerant is expanded in the indoor expansion device 212 located on the secondary side of the indoor heat exchanger 211, thereby turning into low-pressure two-phase refrigerant (refrigerant in which liquid and gas are mixed).

The low-pressure two-phase refrigerant is transported to the heat source-side heat exchanger 113 in the heat source unit 110, through the liquid branch pipe 4*a* and the liquid main pipe 1, and exchanges heat with air in the heat source-side heat exchanger 113 thereby turning into low-pressure gas refrigerant. The low-pressure gas refrigerant is sucked into the compressor 111 through the flow switching device 112 and the accumulator 115, to be again heated and compressed.

(Water-Heating Operation)

In the water-heating operation, the high-pressure gas refrigerant, heated and compressed by the compressor 111, is transported to the hot water supply unit 310 through the flow switching device 112, the gas main pipe 2, and the gas branch pipe 3*b*. The refrigerant transported to the hot water supply unit 310 radiates heat to the heat medium in the heat medium circuit 400 in the hot water supply-side heat exchanger 311, thereby turning into high-pressure liquid refrigerant through condensation. The high-pressure liquid refrigerant is expanded in the hot water supply-side expansion device 312 located on the secondary side of the hot water supply-side heat exchanger 311, thereby turning into low-pressure two-phase refrigerant. The low-pressure two-phase refrigerant is transported to the heat source-side heat exchanger 113 in the heat source unit 110, through the liquid branch pipe 4*b* and the liquid main pipe 1. Thereafter, the refrigerant flows in the same way as in the heating operation.

(Cooling Operation)

In the cooling operation, the high-pressure gas refrigerant, heated and compressed by the compressor 111, is transported to the heat source-side heat exchanger 113 in the heat source unit 110, through the flow switching device 112. The high-pressure gas refrigerant is condensed in the heat source-side heat exchanger 113 upon radiating heat to the air, thereby turning into high-pressure liquid refrigerant. The high-pressure liquid refrigerant is transported to the indoor unit 210 through the liquid main pipe 1 and the liquid branch pipe 4*a*.

The high-pressure liquid refrigerant transported to the indoor unit 210 is expanded in the indoor expansion device 212, thereby turning into low-pressure two-phase refrigerant, and then transported to the indoor heat exchanger 211. In the indoor heat exchanger 211, the low-pressure two-phase refrigerant turns into low-pressure gas refrigerant through heat exchanges with the air. At this point, the air is cooled because heat is removed. The low-pressure gas refrigerant which has flowed out of the indoor unit 210 is transported to the heat source unit 110 through the gas branch pipe 3*a* and the gas main pipe 2. The low-pressure gas refrigerant which has entered the heat source unit 110 is sucked into the compressor 111 through the flow switching device 112 and the accumulator 115, to be again heated and compressed.

(Water-Cooling Operation)

In the water-cooling operation, the high-pressure gas refrigerant, heated and compressed by the compressor 111, is transported to the heat source-side heat exchanger 113 in the heat source unit 110 through the flow switching device 112, as in the case of the cooling operation. The high-pressure gas refrigerant turns into high-pressure liquid refrigerant in the heat source-side heat exchanger 113, and is transported to the hot water supply unit 310 through the liquid main pipe 1 and the liquid branch pipe 4*b*. The high-pressure liquid refrigerant transported to the hot water supply unit 310 is expanded in the hot water supply-side expansion device 312 thereby turning into low-pressure two-phase refrigerant, and then turns into low-pressure gas refrigerant through heat exchange with the heat medium in the hot water supply-side heat exchanger 311. At this point, the heat medium is cooled by being removed heat therefrom. The low-pressure gas refrigerant which has flowed out of the hot water supply unit 310 is transported to the heat source unit 110 through the gas branch pipe 3*b* and the gas main pipe 2. Thereafter, the refrigerant flows in the same way as in the cooling operation.

(Mixed Operation)

In the mixed operation of the heating and the water heating, the high-pressure gas refrigerant, heated and compressed by the compressor 111, branches into the gas branch pipe 3*a* and the gas branch pipe 3*b* through the flow switching device 112 and the gas main pipe 2. The branched flows of the refrigerant respectively pass through the indoor heat exchanger 211 and the indoor expansion device 212 in the indoor unit 210, and the hot water supply-side heat exchanger 311 and the hot water supply-side expansion device 312 in the hot water supply unit 310, and respectively exchange heat with air and with the heat medium, to thereby perform the heating and the hot water supply. Then the refrigerant flows into the liquid branch pipe 4*a* and the liquid branch pipe 4*b* thus to be merged in the liquid main pipe 1, and flows toward the heat source-side heat exchanger 113.

Thereafter, the refrigerant flows in the same way as in the heating operation and the water-heating operation.

In general, in a multi-air-conditioning apparatus for building (hereinafter, VRF), a certain target condensing temperature CTm for allowing the indoor unit 210 to exhibit the expected heating performance is determined, when controlling the heating operation and the water-heating operation. Then the respective refrigerant condensing temperatures CT of the indoor unit 210 and the hot water supply unit 310 are controlled so as to accord with the target condensing temperature CTm. However, when the hot water supply unit 310 is expected to perform like a circulation heating type water heater, controlling the condensing temperature so as to accord with the predetermined target condensing temperature CTm according to the indoor unit 210 leads to degraded stability of the control in a low water temperature range, as well as to degraded COP in a high water temperature range.

Figure 3:
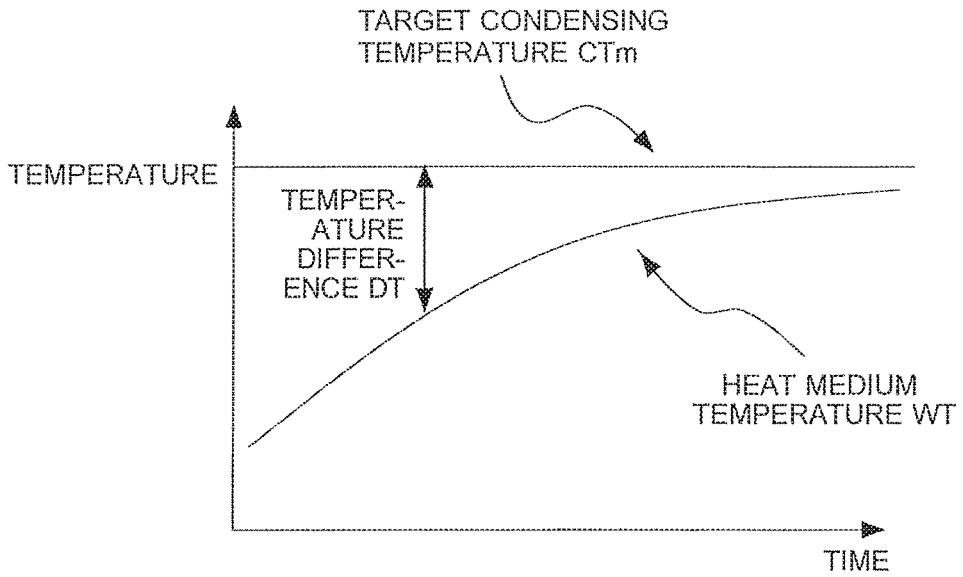
FIG. 3 includes graphs (a) showing a relationship between a heat medium temperature and a target condensing temperature and (b) showing transition of COP, based on conventional art.
Figure 3:
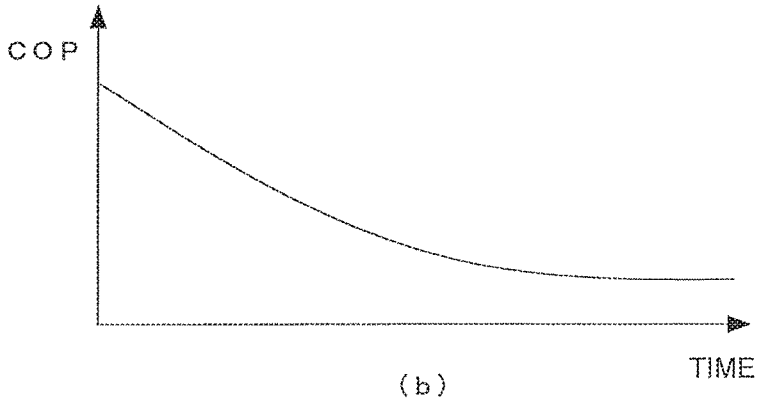

FIG. 3(*a*) is a graph showing a relationship between the target condensing temperature CTm and the heat medium temperature WT, and FIG. 3(*b*) is a graph showing transition of COP, based on the conventional art in which the target condensing temperature CTm is fixed. In FIG. 3(*a*), the vertical axis represents the temperature and the horizontal axis represents the time. In FIG. 3(*b*), the vertical axis represents the COP and the horizontal axis represents the time. The heat medium temperature WT refers to the temperature of the heat medium subjected to the heat exchange in the hot water supply unit 310, for example detected by the inlet temperature sensor 314 in the hot water supply unit 310. As shown in FIG. 3(*a*), when the heat medium temperature WT is high, a temperature difference DT between the target condensing temperature CTm which is fixed and the heat medium temperature WT is small. When the temperature difference DT is thus small, expected heating capacity is unable to be obtained from the power of the compressor 111, and the COP is degraded as shown in FIG. 3(*b*).

In contrast, the temperature difference DT between the target condensing temperature CTm and the heat medium temperature WT increases when the heat medium temperature WT is low. Accordingly, the heating capacity increases with respect to the power of the compressor 111, and the COP is improved. However, the capacity of the compressor 111 is unable to be controlled even when the load required for the hot water supply unit 310 is small (for example, in the case of floor heating to 25 degrees Celsius to 30 degrees Celsius). Therefore, the heat medium temperature WT promptly reaches the target temperature and the hot water supply unit 310 (more precisely the pump 415) is repeatedly activated and stopped, and resultantly the water delivery temperature control becomes unstable in the low temperature range. In the VRF, in particular, the refrigerant pipe length may be shorter or longer depending on the installation worker on site, and hence the time constant between the activation and the stabilization of operation is larger compared with a room air-conditioning apparatus or a chiller. Therefore, for example when the required hot water supply load is satisfied within 15 minutes and the hot water supply unit 310 is stopped in a system configured to be stabilized in 30 minutes after the activation, the COP can only be achieved up to approximately 50%.

With the foregoing problem taken into consideration, the control modes according to Embodiment 1 include, in order to stably control the hot water supply unit 310 and prevent the degradation in COP, a "hot water supply control mode" in which the target condensing temperature CTm is varied according to the heat medium temperature WT in the hot water supply unit 310, and a "hot water supply preheating mode" in which the target condensing temperature CTm is maintained at a fixed level. The "hot water supply control mode" and the "hot water supply preheating mode" are automatically switched between each other by the mode switching unit 124 of the controller 120. More specifically, the mode switching unit 124 selects the hot water supply preheating mode in the heating operation, and selects the hot water supply control mode in the water-heating operation. In addition, in the mixed operation of the heating and the water heating, one of the hot water supply control mode and the hot water supply preheating mode is selected according to the heat medium temperature WT.

Figure 4:
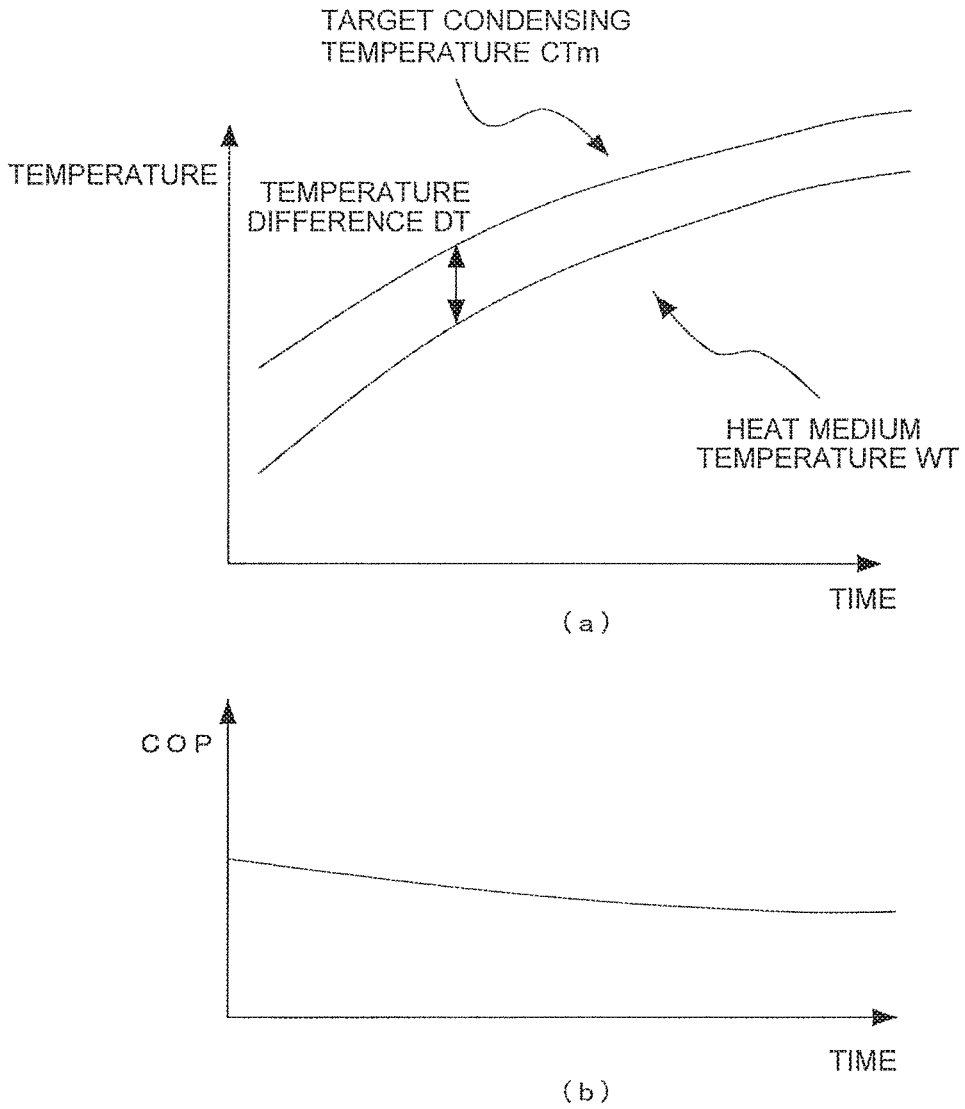
FIG. 4 includes graphs (a) showing a relationship between a heat medium temperature and a target condensing temperature and (b) showing transition of COP, during hot water supply control mode.

In each mode, the target condensing temperature CTm is set by the condensing temperature control unit 125 of the controller 120. FIG. 4(*a*) is a graph showing a relationship between the target condensing temperature CTm and the heat medium temperature WT and FIG. 4(*b*) is a graph showing transition of COP, during hot water supply control mode. In the hot water supply control mode, the condensing temperature control unit 125 of the controller 120 variably sets the target condensing temperature CTm according to the heat medium temperature WT. Specifically, the target condensing temperature CTm is determined with an equation (1) cited below. Thus, the compressor 111 is controlled such that the refrigerant condensing temperature CT of the hot water supply unit 310 (and indoor unit 210) accords with the target condensing temperature CTm.

[Math. 1]

$$\text{Target Condensing Temperature } CTm = \text{Heat Medium Temperature } WT + \alpha \quad (1)$$

Here, the value detected by the inlet temperature sensor 314 received from the hot water supply unit 310 is used as the heat medium temperature WT. Alternatively, the value detected by the outlet temperature sensor 315, the average of the values detected by the inlet temperature sensor 314 and the outlet temperature sensor 315, or the value detected by the water temperature sensor 423 in the hot water storage tank 420 may be adopted as the heat medium temperature WT. Although the constant $\alpha$ may be set to a desired value, it is preferable to determine the constant $\alpha$, through experiments such that the temperature difference DT between the heat medium temperature WT and the target condensing temperature CTm becomes a most efficient value, to avoid the degradation in COP.

Setting the target condensing temperature CTm as above allows the temperature difference DT from the heat medium temperature DT to become constant. Therefore, as shown in FIG. 4(*a*), the temperature difference DT in the low temperature range becomes smaller compared with the case of FIG. 3(*a*). As result, the hot water supply unit 310 is less frequently activated and stopped, which leads to stabilization of the control. In addition, the temperature difference DT in the high-temperature becomes larger compared with the case of FIG. 3(*a*), and therefore a sufficient heating capacity can be secured. As result, the degradation in COP can be suppressed as shown in FIG. 4(*b*), compared with the case of maintaining the target condensing temperature CTm at a fixed value (FIG. 3(*b*)).

Here, one caution is necessary when performing the hot water supply control mode. Since the target condensing temperature CTm is determined according to the heat medium temperature WT in the hot water supply unit 310, the heating energy may be unable to be supplied to the hot water supply unit 310, when high load is required for the room in the mixed operation with respect to the indoor unit 210 and the hot water supply unit 310. In such a case, it is preferable to stop the indoor unit 210 if need be, depending on the temperature difference between the refrigerant condensing temperature CT and the value of a room temperature sensor of the indoor unit 210.

In the hot water supply preheating mode, the condensing temperature control unit 125 sets a fixed target condensing temperature CTm required for performing the heating, as shown in FIG. 3(*a*).

(Mode Switching Process)

Figure 5:
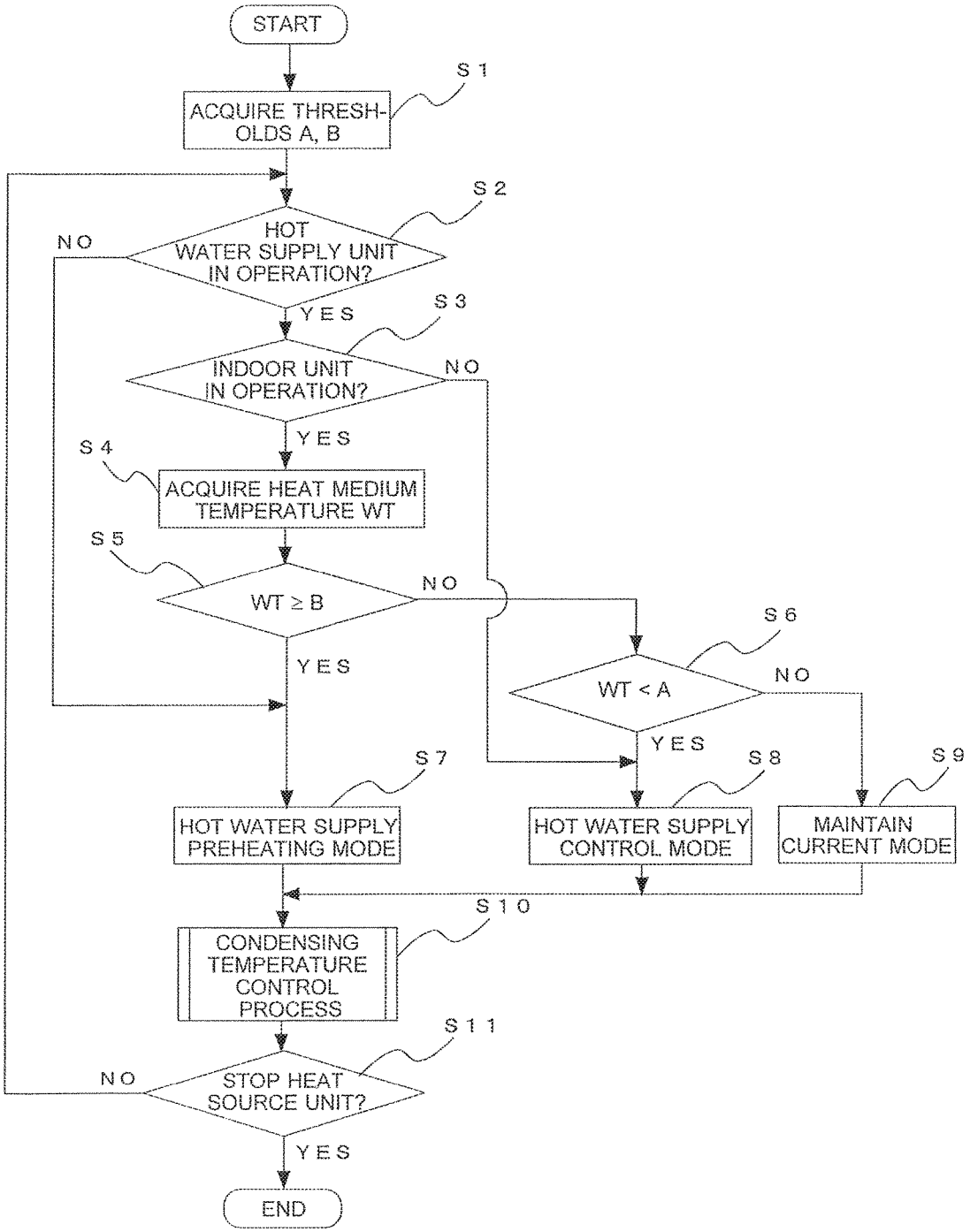
FIG. 5 is a flowchart showing a mode switching process according to Embodiment 1 of the present invention.

FIG. 5 is a flowchart showing a mode switching process to be performed by the mode switching unit 124 according to Embodiment 1. At the start of this process, the control mode is optionally set to one of the "hot water supply control mode" and the "hot water supply preheating mode", as initial mode. When the process starts, a first threshold A and a second threshold B is acquired from the storage unit 123 (S1). The first threshold A and the second threshold B are temperatures used for comparison with the heat medium temperature WT, which are appropriate values for switching the control mode, obtained in advance through experiments and stored in the storage unit 123. The first threshold A and the second threshold B are set so as to satisfy B>A.

Then it is determined whether the hot water supply unit 310 is in operation (S2). When the hot water supply unit 310 is not in operation (S2: NO), the control mode is set to the "hot water supply preheating mode" (S7). When the hot water supply unit 310 is in operation (S2: YES), it is determined whether the indoor unit 210 is in operation (S3). In the case where the air-conditioning and hot water supplying composite system 10 includes a plurality of hot water supply units 310, it is determined at S2 whether one or more hot water supply units 310 are in operation. When one or more hot water supply units 310 are in operation (S2: YES), the process proceeds to S3, and when none of the hot water supply units 310 is in operation (S2: NO), the process proceeds to S7.

When the indoor unit 210 is in operation (S3: YES), the heat medium temperature WT is acquired from the hot water supply unit 310 (S4). When the indoor unit 210 is not in operation (S3: NO), the control mode is set to the "hot water supply control mode" (S8). In the case where the air-conditioning and hot water supplying composite system 10 includes a plurality of indoor units 210, it is determined at S3 whether one or more indoor units 210 are in operation. When one or more indoor units 210 are in operation (S3: YES), the process proceeds to S4, and when none of the indoor units 210 is in operation (S3: NO), the process proceeds to S8. Here, the value detected by the inlet temperature sensor 314 received from the hot water supply unit 310 is used as the heat medium temperature WT. In the case where the air-conditioning and hot water supplying composite system 10 includes a plurality of hot water supply units 310, the heat medium temperature WT of a representative one of the hot water supply units 310, or the average of the heat medium temperatures WT of the respective hot water supply units 310 is acquired.

Once the heat medium temperature WT is acquired at S4, it is determined whether the acquired heat medium temperature WT is equal to or higher than the second threshold B (S5). When the heat medium temperature WT is equal to or higher than the second threshold B (S5: YES), the control mode is set to the "hot water supply preheating mode" (S7). When the heat medium temperature WT is lower than the second threshold B (S5: NO), it is determined whether the heat medium temperature WT is lower than the first threshold A (S6). When the heat medium temperature \NT is lower than the first threshold A (S6: YES), the control mode is set to the "hot water supply control mode" (S8). When the heat medium temperature WT is equal to or higher than the first threshold A (S6: NO), the current control mode is maintained (S9). Thus, when the heat medium temperature WT is between the first threshold A and the second threshold B, the control mode is maintained regardless of the fluctuation of the heat medium temperature WT. Such an arrangement prevents frequent switching between the "hot water supply preheating mode" and the "hot water supply control mode" due to minor temperature fluctuation.

Thereafter, the condensing temperature is controlled according to the control mode selected as above (S10), and it is determined whether the heat source unit 110 is to be stopped (S11). More specifically, it is determined that the heat source unit 110 is to be stopped when an instruction to turn off the thermostat of the heat source unit 110 or to stop the operation thereof is issued. When it is determined that it is not necessary to stop the heat source unit 110 S11: NO), the process returns to S3. The process from S3 to S11 is sequentially repeated at predetermined control time intervals, until the heat source unit 110 is stopped (S11: YES).

(Condensing Temperature Control Process)

Figure 6:
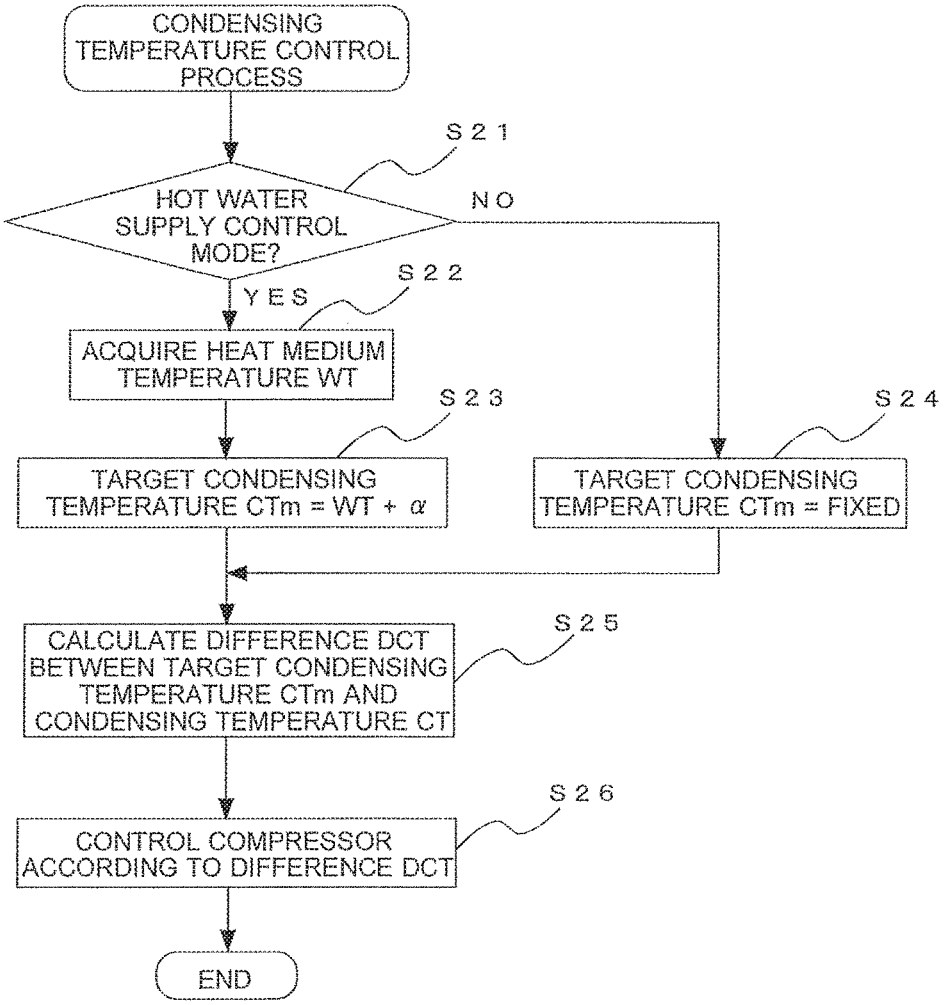
FIG. 6 is a flowchart showing a condensing temperature control process according to Embodiment 1 of the present invention.

Hereunder, the condensing temperature control process of S10 will be described. FIG. 6 is a flowchart showing the condensing temperature control process performed by the condensing temperature control unit 125 according to Embodiment 1. In this process, first it is determined whether the control mode currently set is the "hot water supply control mode" (S21). When the current control mode is the "hot water supply control mode" (S21: YES), the heat medium temperature WT is acquired from the hot water supply unit 310 (S22). Then the target condensing temperature CTm is determined according to the heat medium temperature WT acquired (S23). At this point, the value obtained by adding the constant $\alpha$ to the heat medium temperature WT is determined as the target condensing temperature CTm, according to the equation (1) cited above.

When the current control mode is not the "hot water supply control mode" (S21: NO), it is determined that the current control mode is the "hot water supply preheating mode", and the fixed target condensing temperature CTm is set (S24). More specifically, the target condensing temperature CTm stored in the storage unit 123 is used as it is as the target condensing temperature CTm. Then a difference DCT between the target condensing temperature CTm set at S23 or S24 and the refrigerant condensing temperature CT is calculated (S25). In the hot water supply control mode, the difference DCT between the refrigerant condensing temperature CT of the hot water supply unit 310 and the target condensing temperature CTm set at S23 is calculated, and in the hot water supply preheating mode the difference DCT between the refrigerant condensing temperature CT of the indoor unit 210 and the target condensing temperature CTm set at S24 is calculated. Then the capacity control value (e.g., driving frequency) of the compressor 111 is determined according to the difference DOT calculated as above, and the compressor 111 is controlled so as to realize the determined capacity (S26).

As described above, in Embodiment 1 the hot water supply control mode for primarily performing the hot water supplying operation is set, which is automatically selected according to the operation status of the indoor unit 210 and the hot water supply unit 310 and the heat medium temperature WT. In the hot water supply control mode, the difference between the target condensing temperature CTm and the heat medium temperature WT is maintained at a constant value by variably setting the target condensing temperature CTm according to the heat medium temperature WT, so that the control of the hot water supply unit 310 can be stabilized and the degradation in COP can be prevented.

Embodiment 2

Figure 7:
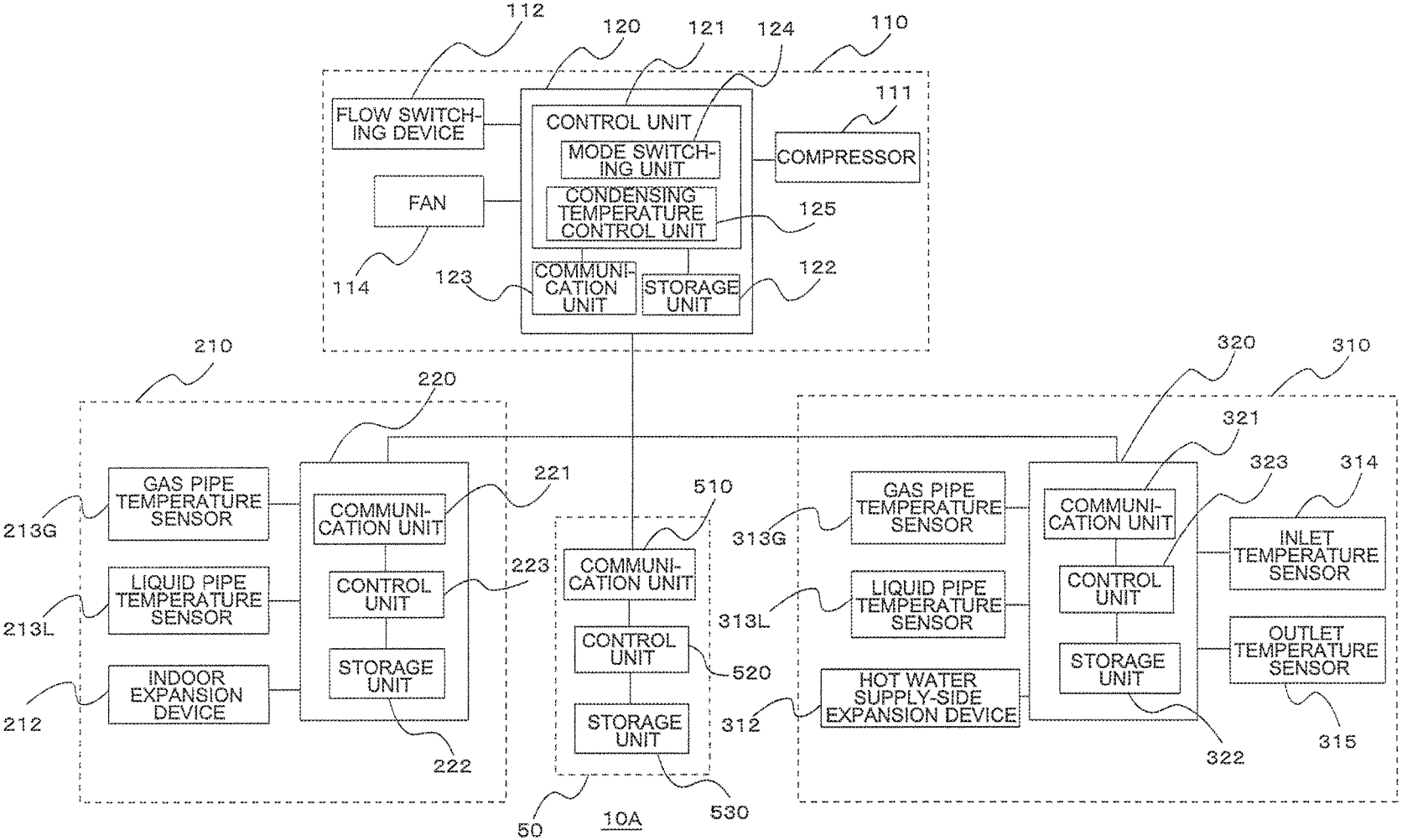
FIG. 7 is a functional block diagram of an air-conditioning and hot water supplying composite system according to Embodiment 2 of the present invention.

Hereunder, description will be given on an air-conditioning and hot water supplying composite system 10A according to Embodiment 2 of the present invention. FIG. 7 is a functional block diagram showing an electrical configuration of the air-conditioning and hot water supplying composite system 10A according to Embodiment 2. As shown in FIG. 7, the air-conditioning and hot water supplying composite system 10A according to Embodiment 2 is different from Embodiment 1 in including an external communication apparatus 50. The refrigerant circuit configuration and the flow of the refrigerant in the air-conditioning and hot water supplying composite system 10A according to Embodiment 2 are the same as those of Embodiment 1.

The external communication apparatus 50 is connected to the heat source unit 110, the indoor unit 210, and the hot water supply unit 310 so as to allow wired or wireless communication. The external communication apparatus 50 includes a control unit 510, a communication unit 520, and a storage unit 530. The control unit 510 monitors the status of the heat source unit 110, the indoor unit 210, and the hot water supply unit 310, and executes various control operations. The communication unit 520 allows wired or wireless communication between the respective controllers of the heat source unit 110, the indoor unit 210, and the hot water supply unit 310, to transmit and receive information. The storage unit 530 stores therein various types of information to be utilized by the control unit 510 to perform the control.

In Embodiment 1, the mode switching unit 124 of the heat source unit 110 switches between the "hot water supply control mode" and the "hot water supply preheating mode" according to the operation status of the indoor unit 210 and the hot water supply unit 310, and the heat medium temperature WT. In Embodiment 2, the external communication apparatus 50 transmits a mode change signal instructing the switching between the "hot water supply control mode" and the "hot water supply preheating mode", to the controller 120.

Figure 8:
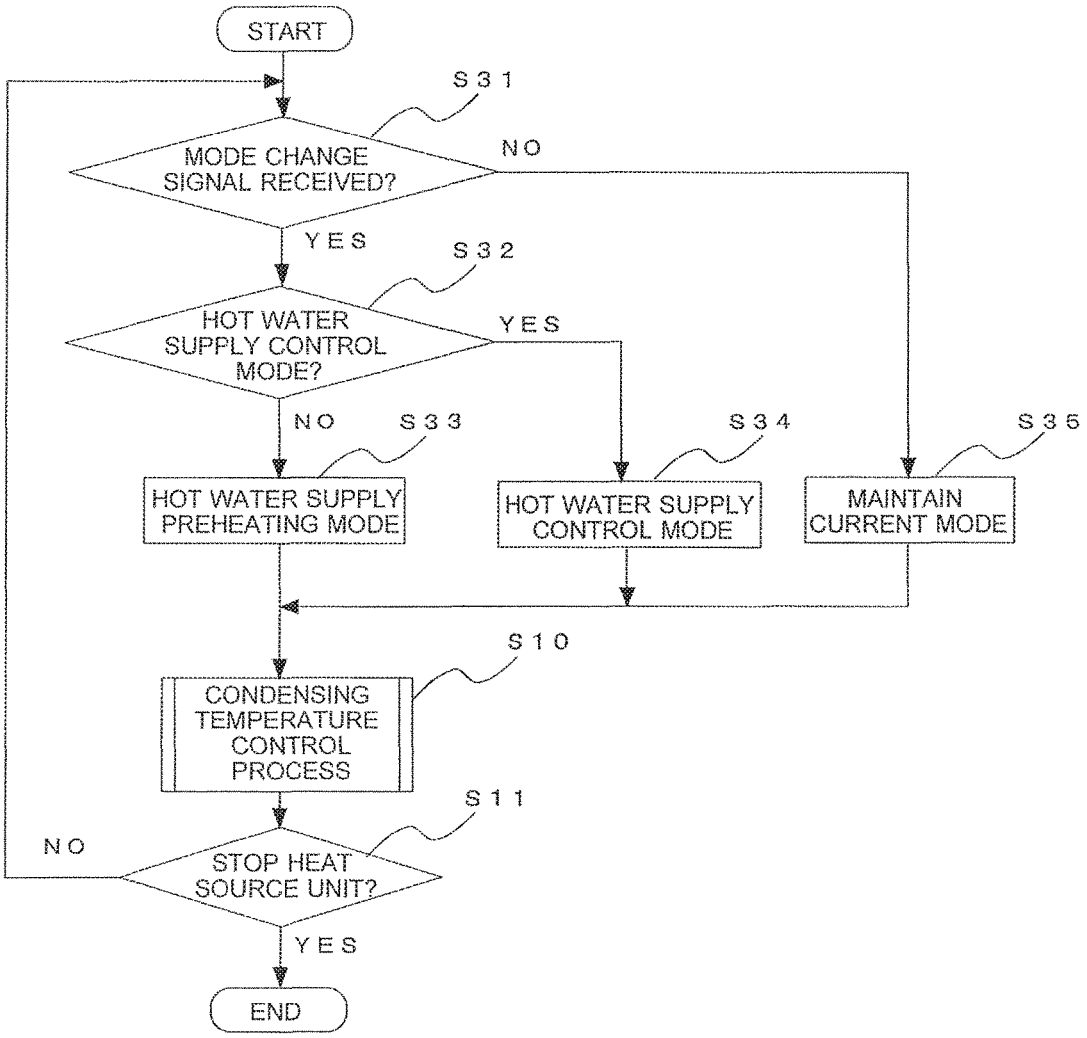
FIG. 8 is a flowchart showing a mode switching process according to Embodiment 2 of the present invention.

FIG. 8 is a flowchart showing the mode switching process according to Embodiment 2. The mode switching process according to Embodiment 2 is executed, as in Embodiment 1, by the mode switching unit 124 of the heat source unit 110. In FIG. 8, the same processes as those of Embodiment 1 are given the same code. At the start of this process, the control mode is optionally set to one of the "hot water supply control mode" and the "hot water supply preheating mode", as initial mode. When the process starts, it is determined whether the mode change signal has been received from the external communication apparatus 50 (S31).

In the case where the mode change signal has been received (S31: YES), it is determined whether the mode change signal is instructing the "hot water supply control mode" (S32). When the mode change signal is instructing the "hot water supply control mode" (S32: YES), the control mode is set to the "hot water supply control mode" (S34). When the mode change signal is not instructing the "hot water supply control mode" (S33: NO), it is determined that the instruction for the "hot water supply preheating mode" has been received, and the control mode is set to the "hot water supply preheating mode" (S33). In the case where the mode change signal has not been received from the external communication apparatus 50 (S31: NO), the current control mode is maintained (S35).

Then the condensing temperature control is performed according to the control mode as in Embodiment 1 (S10), and it is determined whether the heat source unit 110 is to be stopped (S11). In the case where it is not necessary to stop the heat source unit 110 (S11: NO), the process returns to S3. The process from S3 to S11 is sequentially repeated at predetermined control time intervals, until the heat source unit 110 is stopped (S11: YES).

As described above, in Embodiment 2 the control mode is switched according to the instruction from the external communication apparatus 50. Accordingly, the user or manager can operate the external communication apparatus 50 so as to switch the control mode as desired. In addition, an operation for improving the COP in exchange for degradation in heating capacity may be performed, by inputting a demand through the external communication apparatus 50.

Although Embodiments of the present invention have been described as above, the present invention is in no way limited to the configuration of Embodiments, and various modifications and combinations may be made within the technical scope of the present invention. For example, although the "hot water supply control mode" and the "hot water supply preheating mode" are switched between each other by the mode switching unit 124 of the heat source unit 110 or the external communication apparatus 50 in Embodiments, the present invention is not limited to such arrangements, and a dip switch for switching the mode may be provided in the air-conditioning and hot water supplying composite system 10, so as to manually switch the mode.

REFERENCE SIGNS LIST

1: liquid main pipe, 2: gas main pipe, 3*a*, 3*b*: gas branch pipe, 4*a*, 4*b*: liquid branch pipe, 10, 10A: air-conditioning and hot water supplying composite system, 50: external communication apparatus, 110: heat source unit, 111: compressor, 112: flow switching device, 113: heat source-side heat exchanger, 114, 214: fan, 115: accumulator, 116: pressure sensor, 120, 220, 320: controller, 121, 221, 321, 510: control unit, 122, 222, 322, 520: communication unit, 123, 223, 323, 530: storage unit, 124: mode switching unit, 125: condensing temperature control unit, 210: indoor unit, 211: indoor heat exchanger, 212: indoor expansion device, 213G, 313G: gas pipe temperature sensor, 213L, 313L: liquid pipe temperature sensor, 310: hot water supply unit, 311: hot water supply-side heat exchanger, 312: hot water supply-side expansion device, 314: inlet temperature sensor, 315: outlet temperature sensor, 400: heat medium circuit, 411, 412, 414: heat medium pipe, 413: heat medium-water heat exchanger, 415: pump, 420: hot water storage tank, 421, 422: water pipe, 423: water temperature sensor

The invention claimed is:

1. An air-conditioning and hot water supplying composite system comprising:

a heat source unit including a compressor and a heat source-side heat exchanger;

an indoor unit connected to the heat source unit and including an indoor heat exchanger and an indoor expansion device, the indoor unit being configured to perform a heating operation;

a hot water supply unit connected to the heat source unit and including a hot water supply-side heat exchanger and a hot water supply-side expansion device, the hot water supply unit being configured to perform a hot water supplying operation; and a controller configured to control the heat source unit, the controller being configured to switch a control mode between a hot water supply control mode in which the hot water supplying operation is primarily performed and a hot water supply preheating mode in which the heating operation is primarily performed, set a target condensing temperature in accordance with the control mode, and set the target condensing temperature in accordance with a temperature of a heat medium subjected to heat exchange by the hot water supply unit, in the hot water supply control mode.

2. The air-conditioning and hot water supplying composite system of claim 1, wherein the controller is configured to set the target condensing temperature to a value obtained by adding a constant to a temperature of the heat medium, in the hot water supply control mode.

3. The air-conditioning and hot water supplying composite system of claim 1, wherein the controller is configured to set the target condensing temperature to a fixed value in the hot water supply preheating mode.

4. The air-conditioning and hot water supplying composite system of claim 1, wherein the controller is configured to control the compressor to allow a refrigerant condensing temperature of the indoor unit or the hot water supply unit to accord with the target condensing temperature.

5. The air-conditioning and hot water supplying composite system of claim 1, wherein the controller is configured automatically to switch between the hot water supply control mode and the hot water supply preheating mode in accordance with an operation status of the indoor unit and the hot water supply unit.

6. The air-conditioning and hot water supplying composite system of claim 5, wherein the controller is configured to select the hot water supply preheating mode when the indoor unit is in operation and the hot water supply unit is at a stop, and select the hot water supply control mode when the hot water supply unit is in operation and the indoor unit is at a stop.

7. The air-conditioning and hot water supplying composite system of claim 5, wherein the controller is configured automatically to switch between the hot water supply control mode and the hot water supply preheating mode in accordance with the temperature of the heat medium, when the indoor unit and the hot water supply unit are simultaneously in operation.

8. The air-conditioning and hot water supplying composite system of claim 7, wherein the controller is configured to maintain the hot water supply control mode or the hot water supply preheating mode, when the temperature of the heat medium is equal to or higher than a first threshold and lower than a second threshold.

9. The air-conditioning and hot water supplying composite system of claim 1, wherein the controller is configured to communicate with an external communication apparatus, and the controller is configured to switch, when a signal instructing to change the control mode is received from the external communication apparatus, the control mode to a control mode instructed by the received signal.

* * * * *